US011390973B2

(12) United States Patent
Komada et al.

(10) Patent No.: US 11,390,973 B2
(45) Date of Patent: Jul. 19, 2022

(54) PRESSER DEVICE

(71) Applicant: BROTHER KOGYO KABUSHIKI KAISHA, Nagoya (JP)

(72) Inventors: Midori Komada, Matsusaka (JP); Daisuke Ueda, Seto (JP); Nobuhiko Funato, Gifu (JP); Hironori Matsushita, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 106 days.

(21) Appl. No.: 16/751,923

(22) Filed: Jan. 24, 2020

(65) Prior Publication Data

US 2020/0277716 A1 Sep. 3, 2020

(30) Foreign Application Priority Data

Mar. 1, 2019 (JP) ..... JP2019-037189

(51) Int. Cl.
*D05B 29/08* (2006.01)
*D05B 29/12* (2006.01)

(52) U.S. Cl.
CPC ..... *D05B 29/08* (2013.01); *D05B 29/12* (2013.01)

(58) Field of Classification Search
CPC ..... D05B 29/06; D05B 29/08; D05B 29/12; D05B 29/00

(Continued)

(56) References Cited

U.S. PATENT DOCUMENTS 3,511,201 A * 5/1970 Howell ..... D05B 3/18 112/240
4,136,626 A * 1/1979 Kandou ..... D05B 29/06 112/235

(Continued)

FOREIGN PATENT DOCUMENTS

JP H05-88484 U 12/1993
JP 2006-158981 A 6/2006

(Continued)

OTHER PUBLICATIONS

U.S. Appl. No. 16/751,928, filed Jan. 24, 2020 in the name of Yoko Yamanashi et al.

(Continued)

*Primary Examiner* — Nathan E Durham
(74) *Attorney, Agent, or Firm* — Oliff PLC

(57) ABSTRACT

A presser device includes an attachment body, an adjustment member, and a presser body. The attachment body includes an attachment portion and a shaft. The attachment portion is attached to a presser bar included in a sewing machine and extending in a first direction. The shaft extends in a second direction that intersects the first direction. The adjustment member is configured to be screwed together with one end of the shaft and to rotate with respect to the shaft around a rotation axis extending in the second direction. The presser body includes an insertion hole and an insertion portion, the insertion hole penetrating in the first direction. The insertion portion is configured such that the shaft is inserted therethrough. The presser body is configured to move in the second direction with respect to the attachment body along the shaft in accordance with the rotation of the adjustment member.

11 Claims, 10 Drawing Sheets

(58) Field of Classification Search
USPC ..... 112/235
See application file for complete search history.

(56) References Cited

U.S. PATENT DOCUMENTS

| | | | | | |
|---|---|---|---|---|---|
| 5,050,514 | A * | 9/1991 | Niederkorn | ..... | D05B 29/12 112/235 |
| 5,054,407 | A * | 10/1991 | Rowley | ..... | D05B 29/12 112/235 |
| 2017/0073866 | A1 | 3/2017 | Okada | | |

FOREIGN PATENT DOCUMENTS

| | | | |
|---|---|---|---|
| JP | 2017-55876 | A | 3/2017 |
| JP | 3210359 | U | 5/2017 |

OTHER PUBLICATIONS

Jan. 4, 2022 Office Action issued in Japanese Patent Application No. 2019-037189.

* cited by examiner 2
3
21
31
33
9
54
4
43
46
45
44
47
53
5
59
62
UP
LEFT
RIGHT
DOWN

PRESSER DEVICE

CROSS-REFERENCE TO RELATED APPLICATION

This application claims priority to Japanese Patent Application No. 2019-037189 filed Mar. 1, 2019, the content of which is hereby incorporated herein by reference in its entirety.

BACKGROUND

The present disclosure relates to a presser device that can be attached to a presser bar of a sewing machine.

In related art, couching is known in which a pattern is formed on a sewing object by stitching a cord, such as knitting wool, onto the sewing object using a sewing machine, to which a presser device for couching is attached. The presser device for couching has an insertion hole, through which the cord is inserted, and is attached to the presser bar of the sewing machine. By rotating an adjustment screw, the presser device can change a relative position of the presser bar and the insertion hole in the front-rear direction.

SUMMARY

In the known presser device, when the adjustment screw is rotated in a state in which an operator is in front of the sewing machine, it is not easy to ascertain the relative position of the insertion hole with respect to the presser bar in the front-rear direction. When the adjustment screw is rotated in a state in which the operator is on the left side of the sewing machine, it is not easy to perform the operation to rotate the adjustment screw. That is, with the known presser device, the operation to adjust the relative position of the presser bar and the insertion hole is troublesome.

Embodiments of the broad principles derived herein provide a presser device having an insertion hole through which the cord is inserted, configured to be attached to the presser bar of a sewing machine, and can simplify the operation to adjust a relative position of the presser bar of the sewing machine and the insertion hole.

Embodiments provide a presser device that includes an attachment body, an adjustment member, and a presser body. The attachment body includes an attachment portion and a shaft. The attachment portion is attached to a presser bar included in a sewing machine and extending in a first direction. The shaft extends in a second direction that intersects the first direction. The adjustment member is configured to be screwed together with one end of the shaft and to rotate with respect to the shaft around a rotation axis extending in the second direction. The presser body includes an insertion hole and an insertion portion, the insertion hole penetrating in the first direction. The insertion portion is configured such that the shaft is inserted therethrough. The presser body is configured to move in the second direction with respect to the attachment body along the shaft in accordance with the rotation of the adjustment member.

BRIEF DESCRIPTION OF THE DRAWINGS

Embodiments will be described below in detail with reference to the accompanying drawings in which.

DETAILED DESCRIPTION

Figure 1:
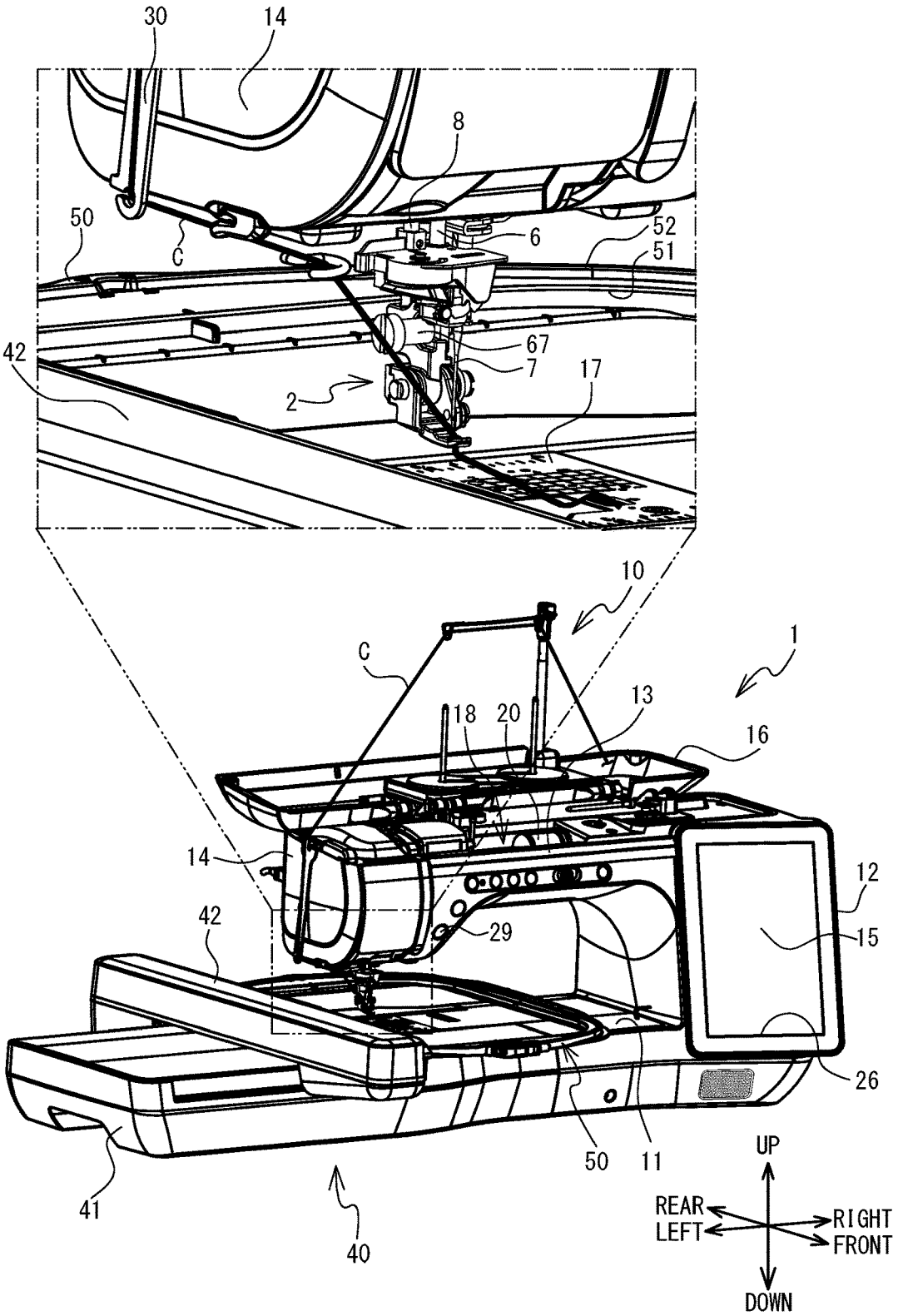
FIG. 1 is a perspective view of a sewing machine on which a presser device and a movement mechanism are mounted.

An embodiment of the present disclosure will be explained with reference to the drawings. A physical configuration of a sewing machine 1 on which a presser device 2 and a movement mechanism 40 are mounted will be explained with reference to FIG. 1. The up-down direction, the lower right side, the upper left side, the lower left side and the upper right side of FIG. 1 respectively correspond to the up-down direction, the front side, the rear side, the left side and the right side of the sewing machine 1 on which the presser device 2 and the movement mechanism 40 are mounted. The longitudinal direction of a bed portion 11 and an arm portion 13 is the left-right direction of the sewing machine 1, and the side on which a pillar 12 is disposed is the right side. The extending direction of the pillar 12 is the up-down direction of the sewing machine 1.

As shown in FIG. 1, the sewing machine 1 is provided with the bed portion 11, the pillar 12, the arm portion 13 and a head portion 14. The bed portion 11 is a base portion of the sewing machine 1 and extends in the left-right direction. The pillar 12 is provided so as to extend upward from the right end portion of the bed portion 11. The arm portion 13 faces the bed portion 11 and extends to the left from the upper end of the pillar 12. The head portion 14 is coupled to the left leading end portion of the arm portion 13.

A feed dog, a feed mechanism, a shuttle mechanism, and the like, which are not shown in the drawings are provided inside the bed portion 11 of the sewing machine 1. When normal sewing that is not embroidery sewing is performed, the feed dog is driven by the feed mechanism and moves a sewing object by a predetermined movement amount. The shuttle mechanism entwines an upper thread (not shown in the drawings) with a lower thread (not shown in the drawings) below a needle plate 17 that is provided on an upper surface of the bed portion 11.

An LCD 15 is provided in the front surface of the pillar 12. The LCD 15 displays a screen including various items, such as commands, illustrations, setting values, messages, and the like. A touch panel 26, which can detect a depressed position, is provided on the front surface side of the LCD 15. When a user performs a pressing operation on the touch panel 26, using a finger or a stylus pen (not shown in the drawings), the touch panel 26 detects the depressed position. A control portion (not shown in the drawings) of the sewing machine 1 detects a selected item on an image, on the basis of the detected depressed position. The sewing machine motor (not shown in the drawings) is provided inside the pillar 12.

An upper portion of the arm portion 13 is provided with a cover 16 that can open and close. FIG. 1 shows the sewing machine 1 when the cover 16 is in an open state. When the cover 16 is in a closed state, a thread housing portion 18 is provided below the cover 16 (namely, inside the arm portion 13). The thread housing portion 18 can house a thread spool 20 around which the upper thread is wound. When the cover 16 is in the open state, a thread spool device 10 can be detachably mounted. The thread spool device 10 can hold two thread spools, and can also guide the upper thread supplied from each of the thread spools toward a sewing needle 7 of the sewing machine 1. When sewing a couching pattern, the thread spool device 10 can guide a cord C, such as wool or a decorative braid, from a supply source (not shown in the drawings) of the cord C toward the presser device 2. The supply source of the cord C is, for example, a roll or the like on which the cord C is wound, and the supply source is disposed to the right of the thread housing portion 18 when the cover 16 is in the open state, or in the vicinity of the sewing machine 1. The drive shaft (not shown in the drawings), which extends in the left-right direction, is provided inside the arm portion 13. The drive shaft is driven to rotate by the sewing machine motor. Various switches, including a start/stop switch 29, are provided on a lower left portion of the front surface of the arm portion 13. The start/stop switch 29 starts or stops the operation of the sewing machine 1, namely, is used to input a sewing start command or a sewing stop command.

The head portion 14 is provided with a needle bar 6, the needle bar up-and-down movement mechanism, a presser bar 8, and the like. The needle bar 6 extends in the up-down direction. The sewing needle 7 is detachably mounted on the lower end of the needle bar 6. The needle bar up-and-down movement mechanism drives the needle bar 6 in the up-down direction as a result of the rotation of the drive shaft. The presser bar 8 extends in the up-down direction to the rear of the needle bar 6. The presser device 2 is detachably attached to the lower end portion of the presser bar 8. When embroidery sewing is performed using an embroidery frame 50, the presser device 2 intermittently presses the sewing object in synchronization with the up-down movement of the needle bar 6. The presser device 2 will be described in more detail later. When the cover 16 is in the open state, a guide member 30 is detachably mounted on the left side of the head portion 14. The guide member 30 extends in the up-down direction, and can guide the cord C toward the presser device 2.

The movement mechanism 40 is detachably mounted on the bed portion 11 of the sewing machine 1. The movement mechanism 40 is provided with a main body portion 41, a carriage 42, and a holder. The carriage 42 is configured to move in the left-right direction with respect to the main body portion 41. The holder is supported, to the right of the carriage 42, so as to be able to move in the front-rear direction with respect to the carriage 42. The embroidery frame 50 that is configured to hold the sheet-shaped sewing object (a work cloth, for example) is detachably mounted on the holder. The embroidery frame 50 is provided with a first frame 51 and a second frame 52, and is configured to clamp the sewing object between the first frame 51 and the second frame 52. In the embroidery sewing using the embroidery frame 50, the movement mechanism 40 can move the embroidery frame 50 mounted on the holder of the carriage 42 to a position indicated by a unique XY coordinate system (an embroidery coordinate system).

Figure 2:
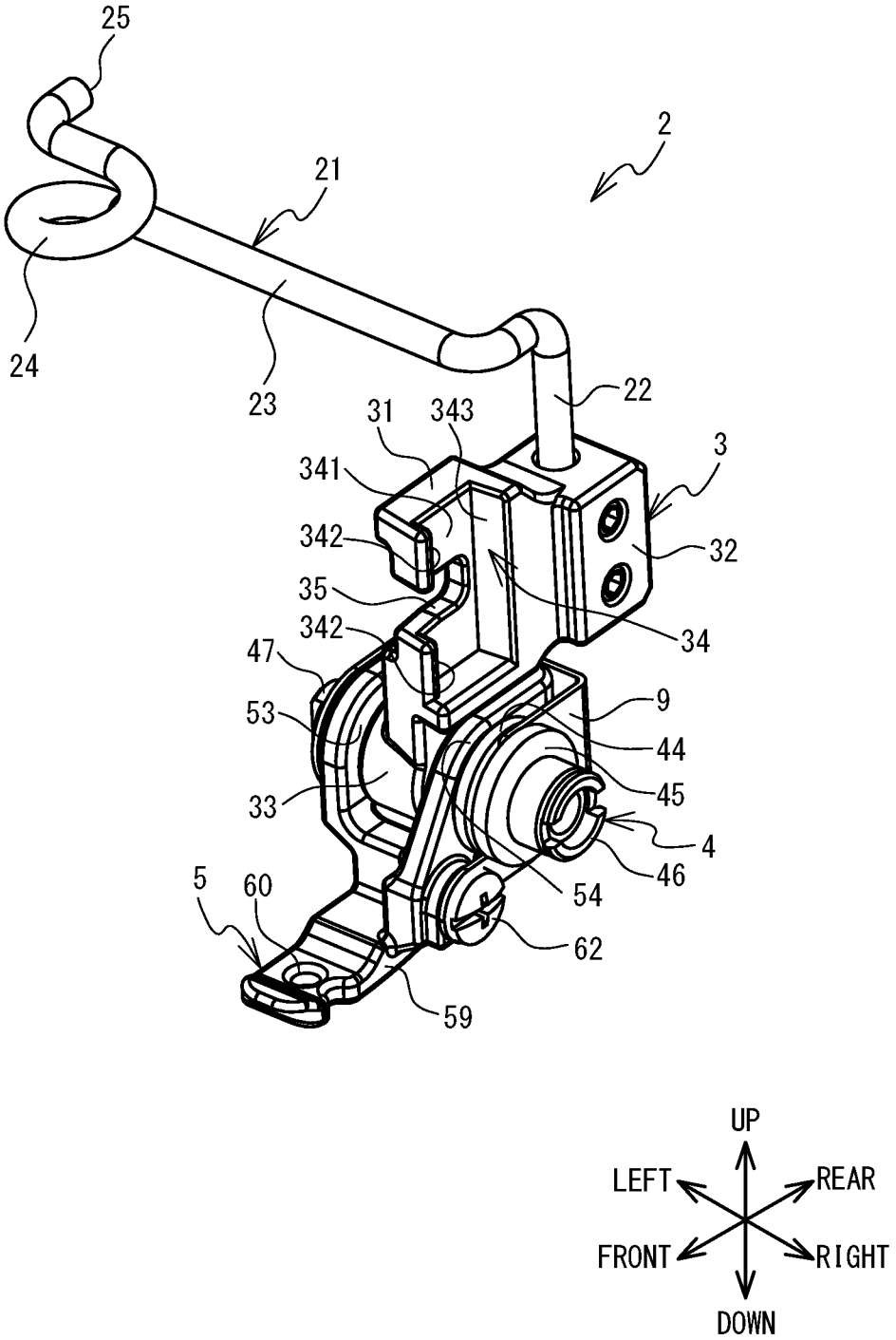
FIG. 2 is a perspective view of the presser device.
Figure 3:
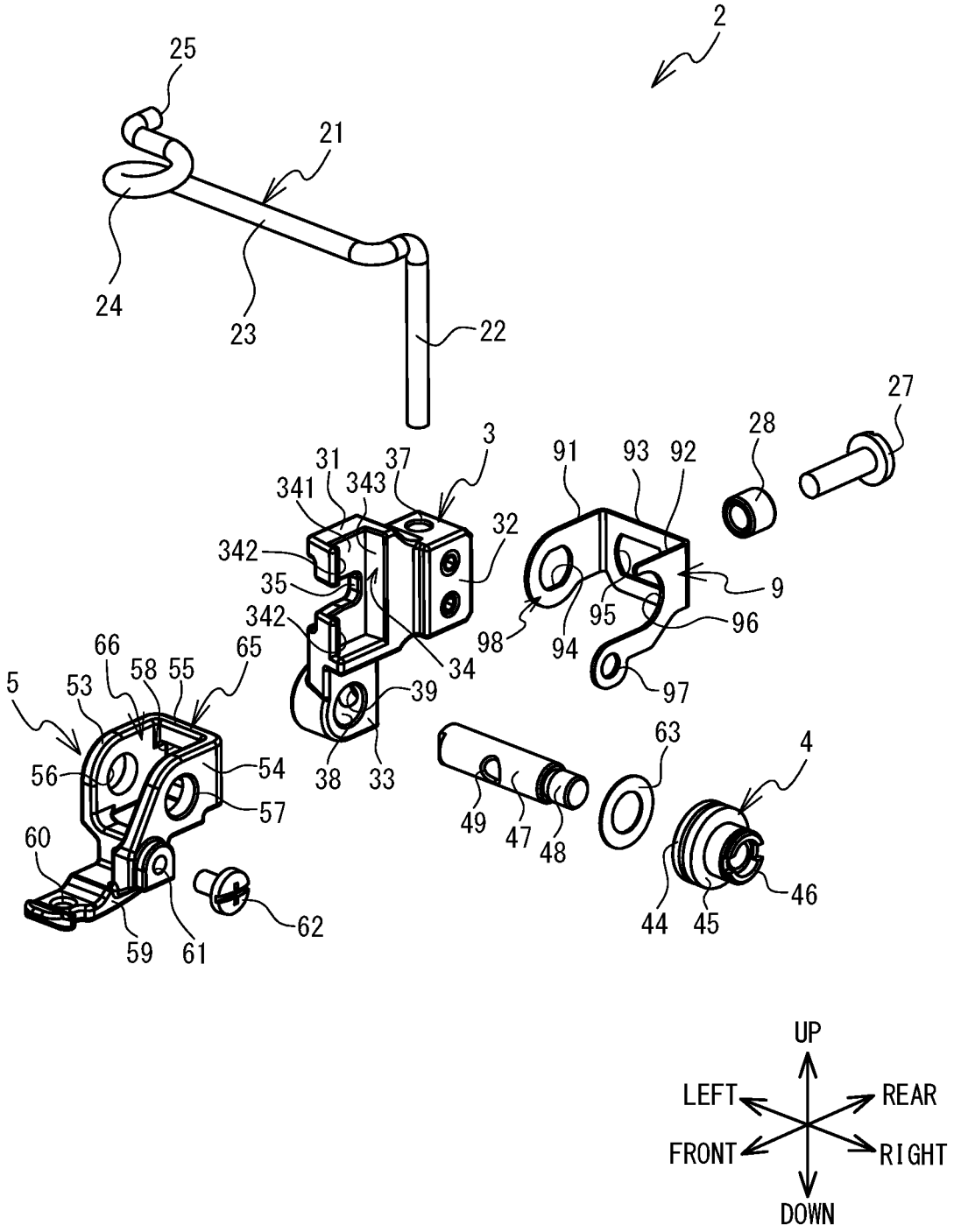
FIG. 3 is an exploded perspective view of the presser device.
Figure 4:
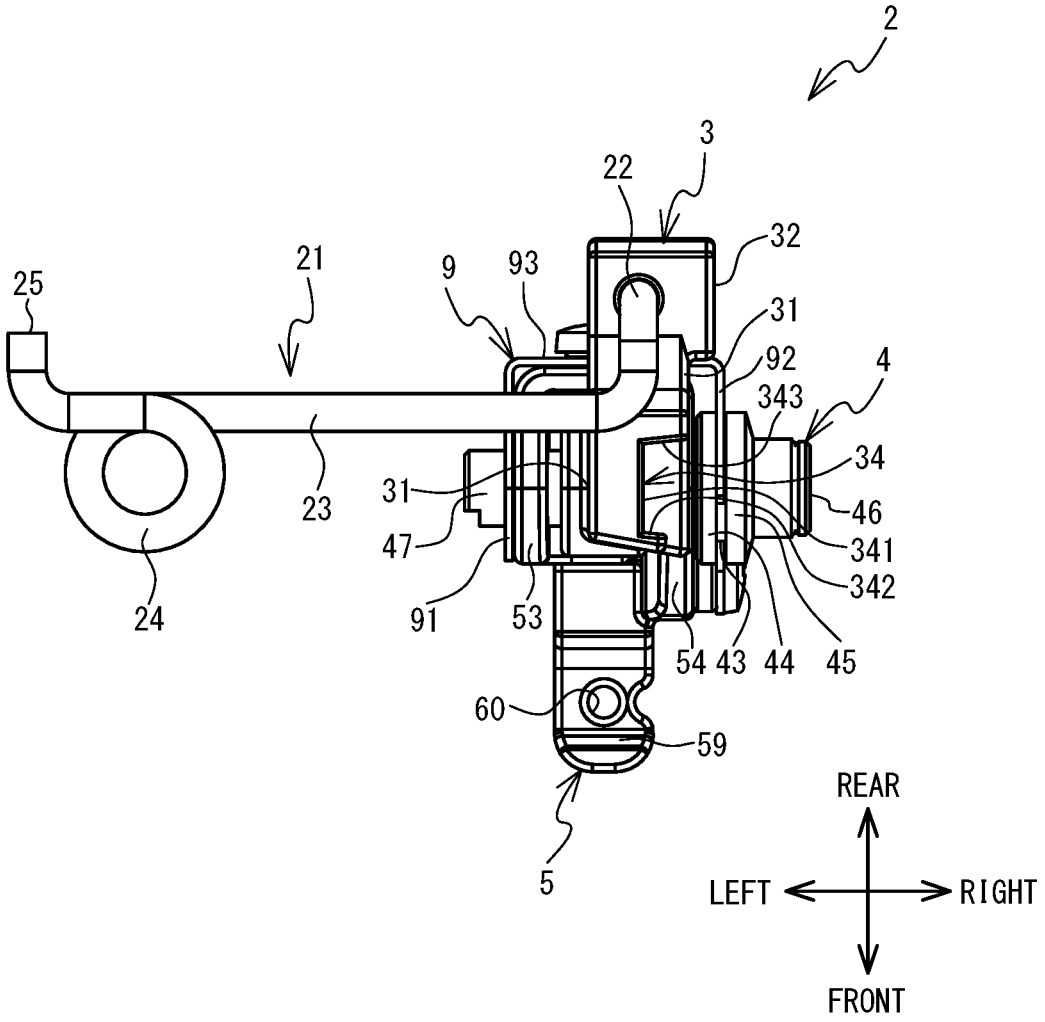
FIG. 4 is a plan view of the presser device.

The presser device 2 will be described with reference to FIG. 2 to FIG. 8. The presser device 2 is a metal presser device that is used when the couching pattern is sewn using the embroidery frame 50 mounted on the movement mechanism 40. As shown in FIG. 2 to FIG. 4, the presser device 2 is provided with an attachment body 3, an adjustment member 4, and a presser body 5. The presser device 2 is further provided with a suppression body 9, and a rotation stopper member 27.

The attachment body 3 is a portion of the presser device 2 that is used to attach the presser device 2 to the lower end of the presser bar 8. The attachment body 3 is provided with an attachment portion 31, and a shaft 47. The attachment body 3 is further provided with support portions 32 and 33, and a guide 21. The attachment portion 31 is attached to the presser bar 8, which is included in the sewing machine 1 and extends in the up-down direction. The attachment portion 31 extends in the up-down direction and has recessed portions 34 and 35. The recessed portion 34 is a portion that is recessed to the left from the right end portion of the attachment portion 31. The recessed portion 34 extends to the upper end of the attachment portion 31. The recessed portion 34 includes a first face 341, a second face 342, and a third face 343. The faces 341 to 343 extend in the up-down direction. When the attachment portion 31 is attached to the presser bar 8, the first face 341 is arranged on the left side of the presser bar 8, the second face 342 is arranged on the front side of the presser bar 8, and the third face 343 is arranged on the rear side of the presser bar 8. The recessed portion 35 is a portion that is recessed to the rear from the front end of the attachment portion 31, in the vicinity of substantially the center of the attachment portion 31 in the up-down direction. The recessed portion 35 is communicated with the recessed portion 34. In a state in which the presser bar 8 is disposed in the recessed portion 34, a screw 67 (refer to FIG. 1), which is inserted through the recessed portion 35 and extends in the left-right direction, is screwed into a screw hole provided in the presser bar 8. Thus, the presser device 2 is removably mounted on the presser bar 8. The support portion 32 is disposed to the rear of the attachment portion 31, and has a cuboid shape that extends in the front-rear direction. The support portion 32 has a hole 37 that is recessed downward from the upper end of the support portion 32. The support portion 32 supports the guide 21 in a state in which the lower end of the guide 21 is inserted through the hole 37.

The guide 21 can guide the cord C to an insertion hole 60 from the left side of the insertion hole 60 of the presser body 5 to be described later. The guide 21 is a member obtained by bending a bar-shaped metal member, and is provided with a mounting portion 22, a support portion 23, and a loop portion 24. The mounting portion 22 extends in the up-down direction. The lower end of the mounting portion 22 is inserted through the hole 37. The support portion 23 is a portion that is bent to the front from the upper end of the mounting portion 22, and thereafter further bent to the left. The support portion 23 extends in the left-right direction. The length of the support portion 23 is longer than the length of the mounting portion 22. One end (the right end) of the loop portion 24 is coupled to the left end of the support portion 23. The loop portion 24 is a portion that is bent into a circular shape counterclockwise in a plan view from the right end of the loop portion 24. Another end 25 of the loop portion 24 is located between the mounting portion 22 and the support portion 23 in the front-rear direction. The other end 25 of the loop portion 24 is positioned higher than the support portion 23 in the up-down direction. The loop portion 24 is positioned to the left and slightly to the rear of the insertion hole 60. At least a part of an extending range of the loop portion 24 in the front-rear direction overlaps an extending range of the attachment portion 31 in the front-rear direction. When the couching pattern is sewn, the cord C is inserted through a hole surrounded by the loop portion 24. As shown in FIG. 4, in a plan view, the length in the front-rear direction between the center of the circle surrounded by the loop portion 24 and the center of the insertion hole 60 of the presser body 5 is shorter than the length in the left-right direction between the center of the circle surrounded by the loop portion 24 and the center of the insertion hole 60 of the presser body 5.

As shown in FIG. 3, the shaft 47 is a bar-shaped member that extends in the left-right direction that intersects the front-rear direction. The shaft 47 has a hole 49, and a male screw portion 48. The hole 49 is positioned in the vicinity of the center of the shaft 47 in the left-right direction. The hole 49 penetrates the shaft 47 in the front-rear direction. The male screw portion 48 is a portion provided at the right end portion of the shaft 47, and has a ridge on the outer circumference thereof. The support portion 33 is provided below the attachment portion 31, and supports the shaft 47. The support portion 33 is provided with a first through hole 38 and a second through hole 39. The first through hole 38 penetrates the support portion 33 in the left-right direction. The first through hole 38 is a circular hole in a left side view, and the shaft 47 is inserted therethrough. The second through hole 39 is a circular hole in a rear view, and extends in the front-rear direction that intersects both the up-down direction and the left-right direction. The second through hole 39 is connected to the first through hole 38. The extending direction of the second through hole 39 is orthogonal to the extending direction of the first through hole 38. Although the second through hole 39 penetrates the support portion 33 to the rear from the first through hole 38, the second through hole 39 does not penetrate the support portion 33 to the front from the first through hole 38. The diameter of the first through hole 38 is larger than the diameter of the second through hole 39.

As shown in FIG. 2 to FIG. 4, the adjustment member 4 is screwed together with the male screw portion 48 provided on the right side of the shaft 47. More specifically, the left end portion of the adjustment member 4 includes a female screw portion 68 (refer to FIG. 7) that is screwed together with the male screw portion 48. In accordance with the rotation of the adjustment member 4, the adjustment member 4 changes the relative position of the shaft 47 of the attachment body 3 and the adjustment member 4 in the left-right direction, in a state in which the relative position of the presser body 5 and the adjustment member 4 in the left-right direction is maintained at the same position. The adjustment member 4 includes a first wall portion 44, a second wall portion 45, a recessed portion 43, and an engagement portion 46. The first wall portion 44 and the second wall portion 45 are arranged side by side in the left-right direction, and are collar-shaped portions that protrude in a direction away from the center of rotation of the adjustment member 4. The first wall portion 44 is located to the left of the second wall portion 45. The recessed portion 43 is positioned between the first wall portion 44 and the second wall portion 45. The adjustment member 4 is engaged with an engagement portion 96 of the suppression body 9, to be described later, in the recessed portion 43 between the first wall portion 44 and the second wall portion 45. The engagement portion 46 is a portion that is provided at the right end of the adjustment member 4. The engagement portion 46 is disposed on the right side of the second wall portion 45, and includes a groove that is configured to be engaged with a jig used to rotate the adjustment member 4.

The presser body 5 is configured to move in the left-right direction with respect to the attachment body 3 along the shaft 47 in accordance with the rotation of the adjustment member 4. The presser body 5 is provided with a mounting portion 65 and a presser portion 59. The mounting portion 65 is a portion used to attach the presser body 5 to the attachment body 3. The mounting portion 65 includes a left wall 53, a right wall 54, and a rear wall 55. The left wall 53 extends substantially parallel to the right wall 54. The rear end of the left wall 53 is coupled to the left end of the rear wall 55, and the rear end of the right wall 54 is coupled to the right end of the rear wall 55. The mounting portion 65 is provided with a recessed portion 66 that is recessed to the rear in a plan view. Three sides of the recessed portion 66 are surrounded by the left wall 53, the right wall 54, and the rear wall 55. The left wall 53 has an insertion portion 56 that is circular in a left side view and that penetrates the left wall 53 in the left-right direction. The right wall 54 has an insertion portion 57 similar to the insertion portion 56. The insertion portion 57 is circular in a left side view, and penetrates the right wall 54 in the left-right direction. The rear wall 55 has a long hole 58 that extends in the left-right direction. The shaft 47 is inserted through the insertion portions 56 and 57. In a state in which the shaft 47 is inserted through the insertion portions 56 and 57, the support portion 33 of the attachment body 3 is disposed between the left wall 53 and the right wall 54, namely, in the recessed portion 66. The right wall 54 comes into contact with the first wall portion 44 of the adjustment member 4 via a washer 63.

The presser portion 59 extends forward from the lower front side of the mounting portion 65. The presser portion 59 has the insertion hole 60, and a screw hole 61. The insertion hole 60 is a through hole that is circular in a plan view, and is provided in the front end portion of the presser portion 59. The sewing needle 7 mounted on the lower end of the needle bar 6, and the cord C that has passed through the loop portion 24 of the guide 21 are inserted through the insertion hole 60. The position of the insertion hole 60 with respect to the presser bar 8 in the left-right direction can be adjusted by the adjustment member 4. The screw hole 61 is a screw hole that is provided in a rear right portion of the presser portion 59 and that extends in the left-right direction.

As shown in FIG. 2 to FIG. 8, the suppression body 9 comes into contact with the adjustment member 4 and suppresses the rotation of the adjustment member 4. The suppression body 9 includes a left wall 91, a right wall 92, and a rear wall 93. The suppression body 9 is a plate spring that is bent in a U shape in a plan view such that a front portion thereof is open. The rear end of the left wall 91 is coupled to the left end of the rear wall 93, and the rear end of the right wall 92 is coupled to the right end of the rear wall 93. The distance between the left wall 91 and the right wall 92 in the left-right direction becomes longer from the front side toward the rear side.

The suppression body 9 is provided with holes 94, 95 and 97, the engagement portion 96, and a recessed portion 98. The hole 94 is an oval hole that is long in the front-rear direction and that penetrates the left wall 91 in the left-right direction. The hole 95 is a long hole that extends in the left-right direction and that penetrates the rear wall 93. The hole 97 is provided in a lower front portion of the right wall 92, and is a through hole that is circular in a left side view. The engagement portion 96 is a portion that is cut out in an arc shape from the front end of the right wall 92 to the rear.

Figure 5:
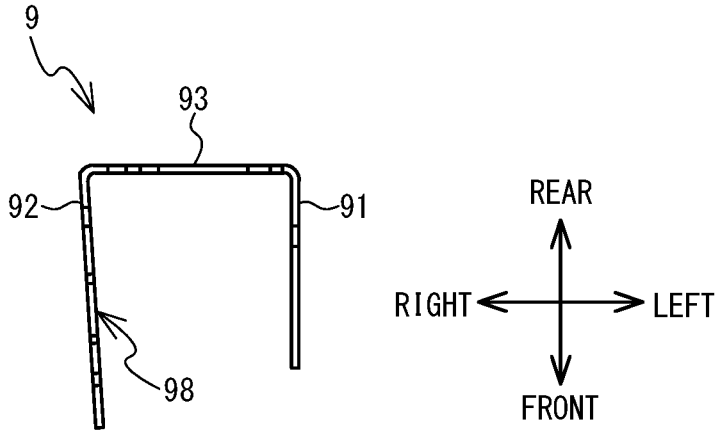
FIG. 5 is a bottom view of a suppression body.
Figure 6:
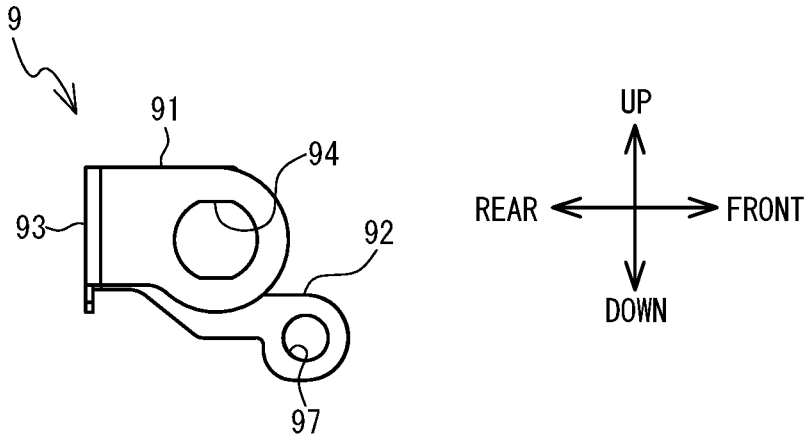
FIG. 6 is a left side view of the suppression body.
Figure 7:
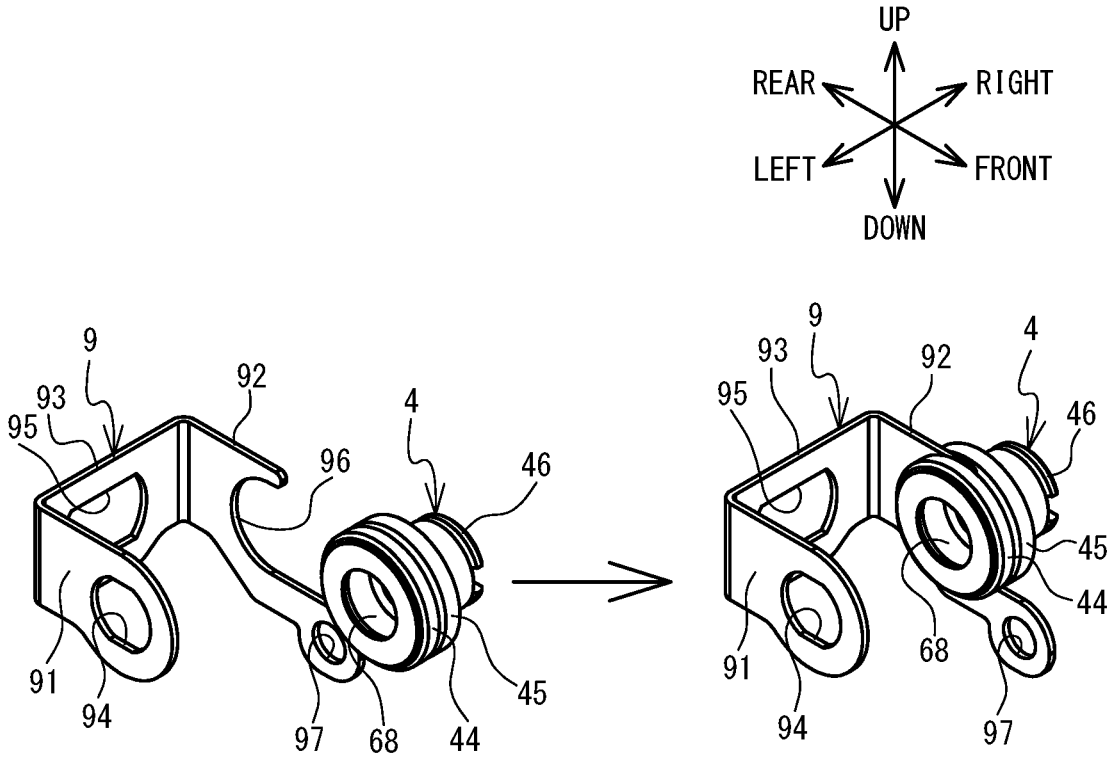
FIG. 7 is an explanatory diagram of an engagement state between an engagement portion of the suppression body and an adjustment member.
Figure 8:
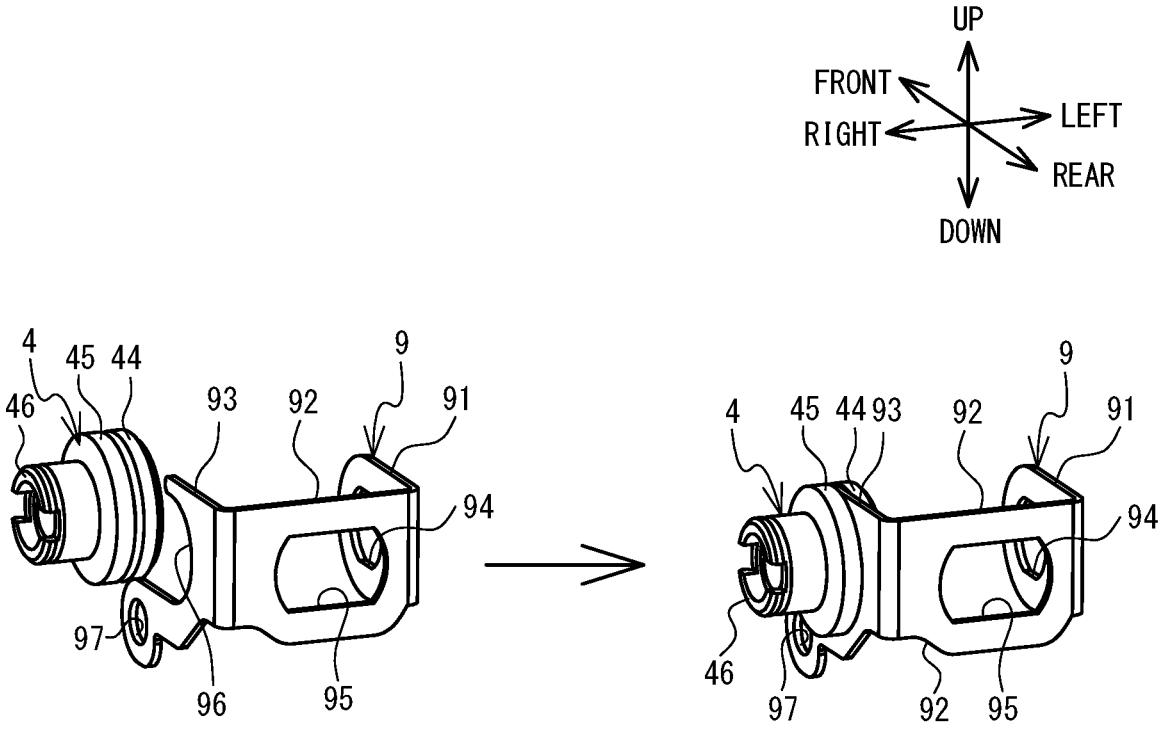
FIG. 8 is an explanatory diagram of the engagement state between the engagement portion of the suppression body and the adjustment member.

The diameter of the arc of the engagement portion 96 is smaller than the diameter of an arc formed by the outer circumference of each of the first wall portion 44 and the second wall portion 45. The engagement portion 96 comes into contact with the recessed portion 43. As shown in FIG. 7 and FIG. 8, the engagement portion 96 engages with the adjustment member 4 between the first wall portion 44 and the second wall portion 45. In a state in which the engagement portion 96 and the adjustment member 4 are engaged with each other, a part of the right wall 92 is positioned between the first wall portion 44 and the second wall portion 45, and the adjustment member 4 can rotate around a rotation axis extending in the left-right direction. As shown in FIG. 5, the recessed portion 98 is a portion that is recessed to the rear in a plan view, and three sides of the recessed portion 98 are surrounded by the left wall 91, the right wall 92, and the rear wall 93.

As shown in FIG. 2 and FIG. 4, the attachment body 3 and the presser body 5 are disposed in the recessed portion 98 of the suppression body 9, and thus the suppression body 9 holds the presser body 5. Specifically, the mounting portion 65 of the presser body 5 is disposed in the recessed portion 98 of the suppression body 9, and the presser body 5, in which the shaft 47 is inserted through the insertion portions 56 and 57, is clamped by the suppression body 9 in the left-right direction. At this time, the left wall 91 is disposed to the left of the left wall 53. The right wall 92 is disposed to the right of the right wall 54, and urges the adjustment member 4 to the right wall 54 side (i.e., to the left). The rear wall 93 is disposed to the rear of the rear wall 55. The shaft 47 is inserted through the hole 94, and the engagement portion 96. The suppression body 9 is fixed to the presser body 5 by a screw 62 that is inserted through the hole 97 and screwed into the screw hole 61. That is, the adjustment member 4 is rotatably fixed to the presser body 5 via the suppression body 9.

As shown in FIG. 3, the rotation stopper member 27 is connected to the attachment body 3, and restricts the rotation of the presser body 5 around the shaft 47. The rotation stopper member 27 is a pin that extends in the front-rear direction. The rotation stopper member 27 is inserted through the long hole 58 of the presser body 5 and is connected to the attachment body 3. More specifically, in a state in which a cylindrical member 28 is outwardly fitted to the rotation stopper member 27, the rotation stopper member 27 is inserted through the hole 95 of the suppression body 9, the long hole 58 of the presser body 5, and the second through hole 39 from the rear side, and is inserted into the hole 49 provided in the shaft 47. The rotation stopper member 27 restricts the support portion 33 from moving in the left-right direction with respect to the shaft 47 or from rotating around the shaft 47. Although the rotation stopper member 27 does not restrict the presser body 5 from moving in the left-right direction with respect to the shaft 47, the rotation stopper member 27 restricts the presser body 5 from rotating around the shaft 47. More specifically, when the presser body 5 tries to rotate around the shaft 47, the long hole 58 comes into contact with the rotation stopper member 27 inserted into the shaft 47, and the presser body 5 is restricted from rotating around the shaft 47.

Figures 9A, 9B, 9C:
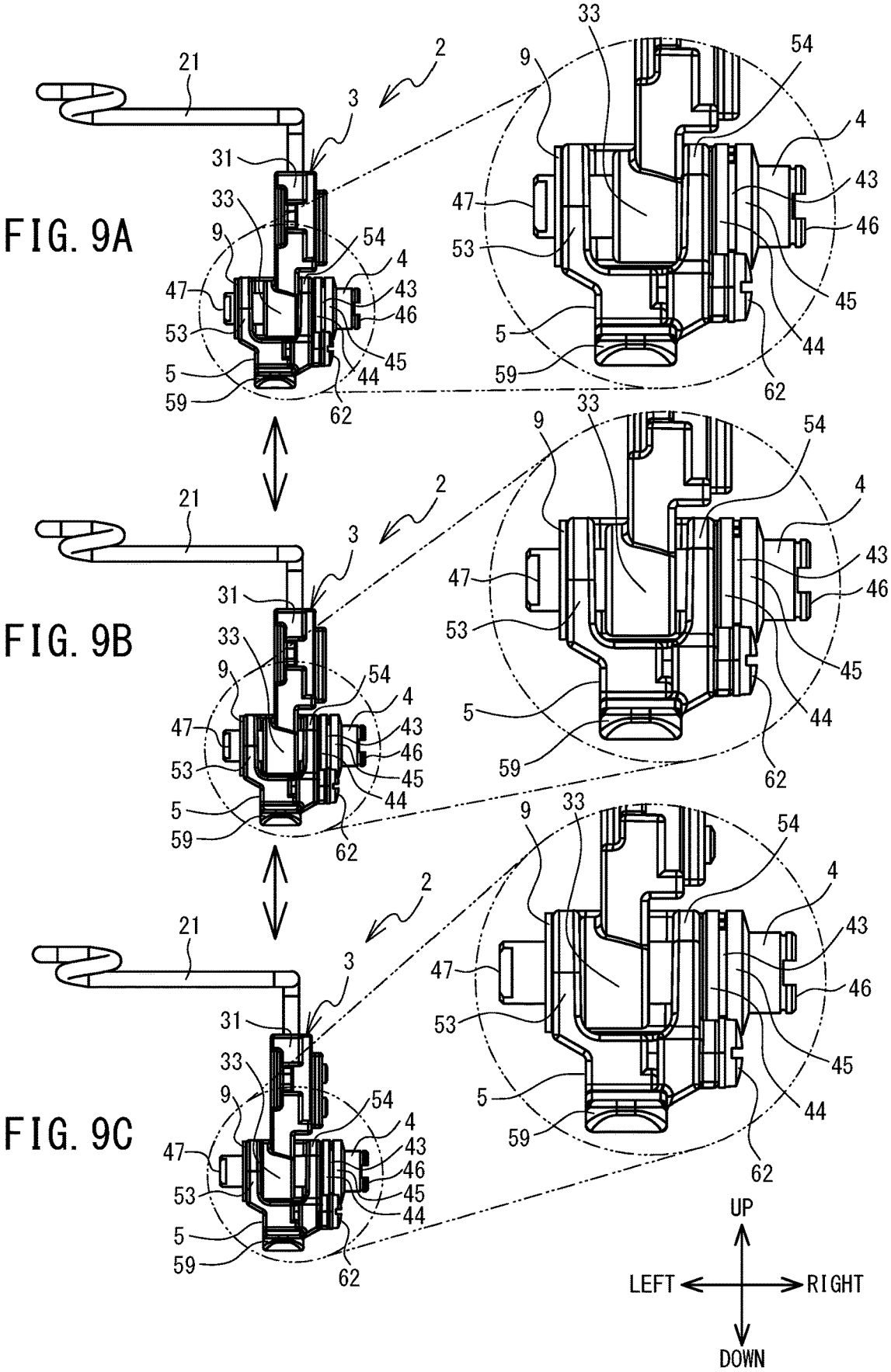
FIG. 9A to FIG. 9C are explanatory diagrams of a relative position of an attachment body and a presser portion.

An operation to adjust the relative position of the presser bar 8 (the attachment body 3) of the sewing machine 1 and the insertion hole 60 will be explained with reference to FIG. 9A to FIG. 9C. For example, in a state in which an operator is positioned in front of the sewing machine 1, the operator rotates the adjustment member 4 using the jig. In the state in which the relative position of the presser body 5 and the adjustment member 4 in the left-right direction is maintained at the same position, the relative position of the shaft 47 of the attachment body 3 and the adjustment member 4 in the left-right direction is changed in accordance with the rotation of the adjustment member 4. Since the attachment body 3 is fixed to the presser bar 8, the position of the attachment body 3 with respect to the presser bar 8 is not changed in accordance with the rotation of the adjustment member 4. In accordance with the rotation of the adjustment member 4, the presser body 5 moves along the shaft 47 with respect to the presser bar 8. FIG. 9A shows a case in which the presser body 5 is positioned at the left end portion of a movable range of the presser body 5. In FIG. 9A, the support portion 33 of the attachment body 3 is in contact with the right wall 54 of the presser body 5 and is separated from the left wall 53. FIG. 9B shows a case in which the presser body 5 is positioned at the center, in the left-right direction, of the movable range. In FIG. 9B, the support portion 33 of the attachment body 3 is positioned at the center between the left wall 53 and the right wall 54 of the presser body 5, and is separated from both the left wall 53 and the right wall 54. FIG. 9C shows a case in which the presser body 5 is positioned at the right end portion of the movable range. In FIG. 9C, the support portion 33 of the attachment body 3 is in contact with the left wall 53 of the presser body 5 and is separated from the right wall 54. In the presser device 2, the presser body 5 moves in the left-right direction, which is the same as the extending direction of the shaft 47 of the attachment body 3, with respect to the attachment body 3. Therefore, while rotating the adjustment member 4, the operator can easily ascertain the relative position of the insertion hole 60 with respect to the presser bar 8 in the left-right direction. When the operator determines that the relative position of the presser bar 8 of the sewing machine 1 and the insertion hole 60 is an appropriate position, the operator ends the adjustment operation.

An example of an operation when the couching pattern is sewn by the sewing machine 1, using the presser device 2 and the embroidery frame 50 mounted on the movement mechanism 40, will be explained with reference to FIG. 1. In the same manner as the normal embroidery sewing, the operator mounts the upper thread and the lower thread on the sewing machine 1. The operator mounts the embroidery frame 50, on which the sewing object is mounted, on the movement mechanism 40. The operator attaches the presser device 2 to the presser bar 8. The operator rotates the adjustment member 4 around the rotation axis extending in the left-right direction using the jig, and thus adjusts the position of the insertion hole 60 with respect to the presser bar 8 in the left-right direction. The operator hooks the cord C on the thread spool device 10, the guide member 30, and the loop portion 24, and passes the cord C through the insertion hole 60 from above. After the operator selects pattern data to sew the couching pattern, the operator inputs a sewing start command by selecting the start/stop switch 29. When the sewing start command is acquired, the control portion of the sewing machine 1 drives the movement mechanism 40 and the needle bar up-and-down movement mechanism in accordance with the pattern data, and forms the pattern on the sewing object by stitching the cord C onto the sewing object.

In the presser device 2 of the above-described embodiment, the presser body 5 moves in the left-right direction, which is the same as the extending direction of the shaft 47 of the attachment body 3, with respect to the attachment body 3. Therefore, while rotating the adjustment member 4, the operator can easily ascertain the relative position of the insertion hole 60 with respect to the presser bar 8 in the left-right direction. Thus, in comparison to a known device, the presser device 2 can simplify the operation by the operator to adjust the relative position of the presser bar 8 of the sewing machine 1 and the insertion hole 60.

The adjustment member 4 is fixed to the presser body 5, and in the state in which the relative position of the presser body 5 and the adjustment member 4 in the left-right direction is maintained at the same position, the relative position of the shaft 47 of the attachment body 3 and the adjustment member 4 in the left-right direction is changed in accordance with the rotation of the adjustment member 4. The presser device 2 can integrally move the adjustment member 4 and the presser body 5 with respect to the attachment body 3.

The presser device 2 is provided with the suppression body 9 that comes into contact with the adjustment member 4 and suppresses the rotation of the adjustment member 4. Using the suppression body 9, the presser device 2 can suppress the adjustment member 4 from rotating due to vibrations or the like at the time of sewing. Thus, in comparison to a device that does not include the suppression body 9, the presser device 2 can reduce a possibility that the relative position of the presser bar 8 of the sewing machine 1 and the insertion hole 60 may be changed during the sewing.

The insertion portions 56 and 57 of the presser body 5 are through holes. The shaft 47 of the attachment body 3 is inserted through the insertion portions 56 and 57. The suppression body 9 includes the engagement portion 96, with which the adjustment member 4 is rotatably engaged, and the recessed portion 98 that is recessed to the rear. The attachment body 3 and the presser body 5 are disposed in the recessed portion 98 of the suppression body 9, and thus the suppression body 9 holds the presser body 5. In the presser device 2, the suppression body 9 is engaged with the adjustment member 4, and also holds the presser body 5. When the adjustment member 4 is rotated, although the relative position of the adjustment member 4 and the presser body 5 is not changed, the relative position of the adjustment member 4 and the attachment body 3 is changed. Thus, by rotating the adjustment member 4 using a relatively simple configuration, the presser device 2 can adjust the relative position of the presser bar 8 of the sewing machine 1 and the insertion hole 60. The support portion 33 of the attachment body 3 is disposed in the recessed portion 66 of the presser body 5, and the presser body 5 is supported by the shaft 47 inserted through each of the insertion portion 56 of the left wall 53 and the insertion portion 57 of the right wall 54. Thus, in the presser device 2, an inclination of the presser body 5 in the left-right direction is easily stabilized, in comparison to a device in which the presser body 5 is supported at one point.

The adjustment member 4 includes the first wall portion 44 and the second wall portion 45 that are arranged side by side in the left-right direction, and is engaged with the engagement portion 96 between the first wall portion 44 and the second wall portion 45. The suppression body 9 of the presser device 2 can maintain the engagement of the adjustment member 4 with the engagement portion 96 of the suppression body 9, regardless of whether the adjustment member 4 is moved to the left or to the right with respect to the presser bar 8. Thus, the presser device 2 can reduce a possibility that the relative position of the presser bar 8 of the sewing machine 1 and the insertion hole 60 may be changed during the sewing due to the release of the engagement of the adjustment member 4 with the engagement portion 96 of the suppression body 9. The right wall 92 of the suppression body 9 urges the first wall portion 44 of the adjustment member 4 to the support portion 33 side (to the left) of the attachment body 3. Therefore, the presser device 2 can favorably suppress the rotation of the adjustment member 4, in comparison to a device that does not urge the adjustment member 4 to the support portion 33 side of the attachment body 3.

When the couching pattern is sewn using the embroidery frame 50, it is preferable that the presser portion 59 is disposed substantially parallel to the sewing object held by the embroidery frame 50, and the presser portion 59 preferably does not rotate with respect to the shaft 47. To address this, the presser device 2 is provided with the rotation stopper member 27 that is connected to the attachment body 3 and that restricts the rotation of the presser body 5 around the shaft 47. The presser device 2 can restrict the presser body 5 from rotating around the shaft 47 at the time of sewing. Thus, the presser device 2 can reduce a possibility that the relative position of the presser bar 8 of the sewing machine 1 and the insertion hole 60 may be changed due to the rotation of the presser body 5 around the shaft 47.

The presser body 5 of the presser device 2 has the long hole 58 that extends in the left-right direction. The rotation stopper member 27 is inserted through the long hole 58 and is connected to the attachment body 3. Thus, the presser device 2 can have a relatively simple configuration to restrict the presser body 5 from rotating around the shaft 47.

The attachment body 3 includes the shaft 47 which extends in the left-right direction and which has the hole 49, the first through hole 38 which penetrates in the left-right direction and through which the shaft 47 is inserted, and the second through hole 39 which is connected to the first through hole 38 and which extends in the backward direction that intersects both the up-down direction and the left-right direction. The rotation stopper member 27 is inserted through the long hole 58 of the presser body 5 and the second through hole 39, and is inserted into the hole 49 provided in the shaft 47. Thus, the presser device 2 can have a relatively simple configuration to restrict the presser body 5 from rotating around the shaft 47.

The attachment body 3 includes the guide 21 that guides the cord C to the insertion hole 60 from the left side of the insertion hole 60. The cord C that is inserted through the insertion hole 60 is pulled from the supply source of the cord C toward the insertion hole 60. Thus, generally, it is particularly important to adjust the relative position of the insertion hole 60 with respect to the presser bar 8, in a position in a supply direction in which the cord C is supplied to the insertion hole 60. Using the guide 21, the presser device 2 can regulate the supply direction of the cord C that is inserted through the insertion hole 60 to the left-right direction. The loop portion 24 is positioned to the left and slightly to the rear of the insertion hole 60 of the presser body 5. On the other hand, the upper thread is supplied to the sewing needle 7 from the front right side. In the sewing machine 1 on which the presser device 2 has been mounted, the supply path of the cord C to the insertion hole 60 does not overlap the supply path of the upper thread, and the cord C and the upper thread are unlikely to become entangled.

The presser device of the present disclosure are not limited to the above-described embodiment, and various modifications may be made without departing from the broad spirit and scope of the present disclosure. For example, the following modifications may be added as appropriate.

The configuration of the sewing machine 1, on which the presser device 2 can be mounted, may be changed as appropriate. It is sufficient that the sewing machine 1 is a sewing machine that can perform embroidery sewing by moving, with respect to a needle bar, an embroidery frame that is holding a sewing object. The sewing machine 1 may be a sewing machine dedicated to embroidery, an industrial sewing machine, or a multi-needle sewing machine. The shape and the size of the embroidery frame 50 may be changed as appropriate, and the shape may be circular, oval or the like, for example.

The shape, the configuration and the like of the attachment body 3 may be changed as appropriate. It is sufficient that the extending direction of the shaft 47 of the attachment body 3 is a direction that intersects the extending direction of the presser bar 8, and the extending direction of the shaft 47 may be changed as appropriate. The shaft 47 of the attachment body 3 may be formed integrally with the attachment portion 31. It is sufficient that the adjustment member 4 is screwed together with the shaft 47. For example, at least one selected from the group of the first wall portion 44 and the second wall portion 45 of the adjustment member 4 may be omitted. The shape, the configuration and the like of the presser body 5 may be changed as appropriate.

The shaft 47 may be movably inserted through the attachment portion 31 and may be immovably inserted through the presser body 5. In this case, the adjustment member 4 may be configured such that, in a state in which the relative position of the shaft 47 of the attachment body 3 and the adjustment member 4 in the left-right direction is maintained at the same position, the relative position of the presser body 5 and the adjustment member 4 in the left-right direction can be changed in accordance with the rotation of the adjustment member 4. The adjustment member 4 may be an adjustment screw having a male screw portion. In this case, the shaft 47 of the attachment body 3 may have a female screw portion that is screwed together with the male screw portion. The presser device 2 may be provided with a suppression body that comes into contact with the shaft 47 of the attachment body 3 and thus suppresses the rotation of the adjustment member 4 that is screwed together with the shaft 47. It is sufficient that the insertion portions 56 and 57 of the presser body 5 are configured such that the shaft 47 of the attachment body 3 can be inserted therethrough. For example, the insertion portions 56 and 57 may be through holes of any shape that penetrate in the extending direction of the shaft 47, or may be cutouts.

The suppression body 9 may be omitted. The suppression body 9 may be a member that suppresses the adjustment member 4 from rotating due to a friction force of a portion that comes into contact with the adjustment member 4. When dial notch-shaped concavities and convexities are provided on the outer circumference of the adjustment member 4, the presser device 2 may use a member that is engaged with the concavities and convexities as a suppression body, in place of the suppression body 9.

Figure 10:
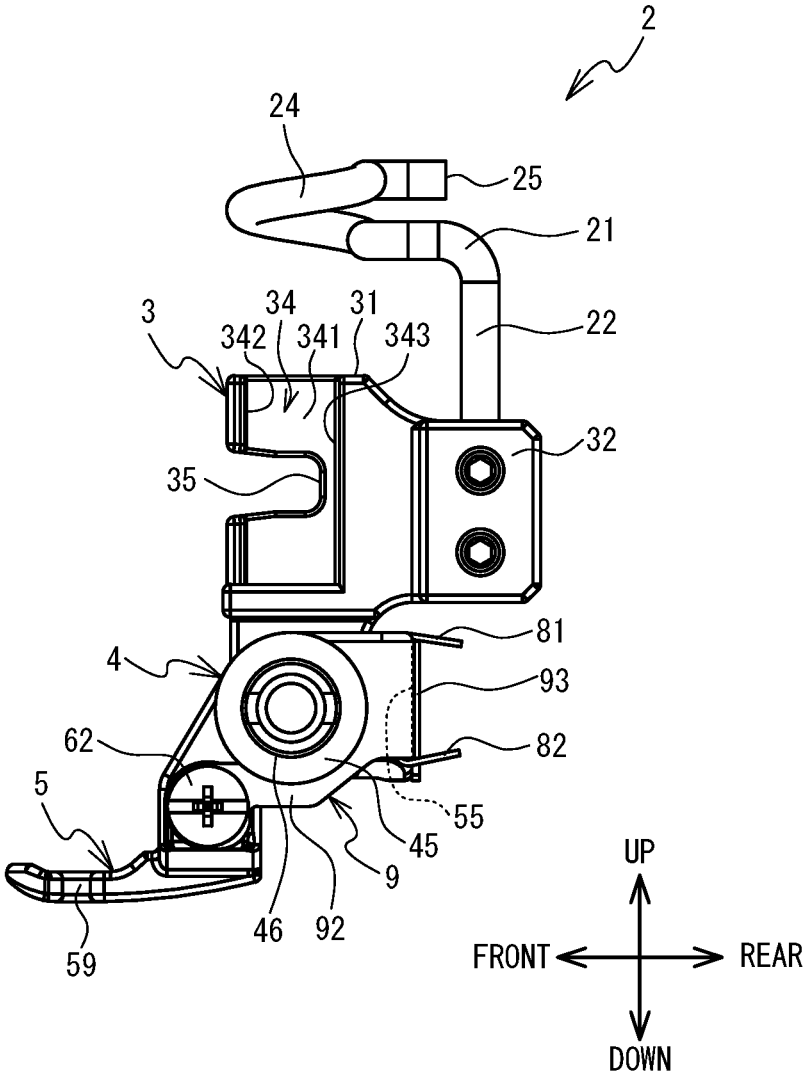
FIG. 10 is a right side view of the presser device of a modified example.

The rotation stopper member 27 may be omitted. The configuration of the rotation stopper member 27 may be changed as appropriate. For example, the configuration of the rotation stopper member 27 of the presser device 2 may be changed to a configuration of a modified example shown in FIG. 10. The presser device 2 of the modified example shown in FIG. 10 is provided with rotation stopper members 81 and 82, in place of the rotation stopper member 27. The other structural members are the same as those of the above-described embodiment. The rotation stopper member 81 is a plate spring that extends to the rear and slightly downward from the upper rear end of the support portion 33 of the attachment body 3. The rotation stopper member 82 is a plate spring that extends to the rear and slightly upward from the lower rear end of the support portion 33 of the attachment body 3. The rotation stopper members 81 and 82 clamp, and thus hold, the rear wall 55 of the presser body 5 and the rear wall 93 of the suppression body 9 in the up-down direction. When the presser body 5 tries to rotate around the shaft 47, the rotation stopper members 81 and 82 come into contact with the rear wall 55 of the presser body 5, and restrict the presser body 5 from rotating around the shaft 47. In the presser device 2 of the modified example, the long hole 58 of the presser body 5 and the hole 95 of the suppression body 9 may be omitted, and the shaft 47 and the attachment portion 31 may be formed integrally. The attachment portion 31 may include a forth face that is arranged on right side of the presser bar 8 when the attachment portion 31 is attached to the presser bar 8. The recessed portion 34 may be a portion that is recessed to the downward from the top end portion of the attachment portion 31. The attachment portion 31 may include the forth face instead of the first face 341. The recessed portion 34 may be a portion that is recessed to the right from the left end portion of the attachment portion 31.

The guide 21 that guides the cord C to the insertion hole 60 of the presser body 5 may be omitted. The guide 21 may be attached not to the presser device 2 but to the sewing machine 1. The shape, the configuration and the like of the guide 21 may be changed as appropriate. For example, in the presser device 2, the relative position of the loop portion 24 with respect to the insertion hole 60 may be changed as appropriate. For example, the loop portion 24 may be disposed to the right of the insertion hole 60.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A presser device comprising:

an attachment body including an attachment portion and a shaft, the attachment portion being configured to be attached to a presser bar included in a sewing machine and extending in a first direction, and the shaft extending in a second direction that intersects the first direction;

an adjustment member configured to be screwed together with one end of the shaft and to rotate with respect to the shaft around a rotation axis extending in the second direction, the adjustment member having an engagement portion on a distal end in the second direction, the engagement portion being configured to be engaged with a jig used to rotate the adjustment member, the one end of the shaft on which the adjustment member is configured to be screwed onto having a diameter that is less than the diameter of a remainder of the shaft; and a presser body including an insertion hole and an insertion portion, the insertion hole penetrating in the first direction, the insertion portion being configured such that the shaft is inserted therethrough, and the presser body being configured to move in the second direction with respect to the attachment body along the shaft in accordance with the rotation of the adjustment member.

2. The presser device according to claim 1, wherein the adjustment member is fixed to the presser body, and in a state in which a relative position of the presser body and the adjustment member in the second direction is maintained at a same position, a relative position of the shaft of the attachment body and the adjustment member in the second direction is changed in accordance with the rotation of the adjustment member.

3. The presser device according to claim 1, further comprising:

a suppression body configured to come into contact with the adjustment member and to suppress the rotation of the adjustment member.

4. A presser device comprising:

an attachment body including an attachment portion and a shaft, the attachment portion being configured to be attached to a presser bar included in a sewing machine and extending in a first direction, and the shaft extending in a second direction that intersects the first direction;

an adjustment member configured to be screwed together with one end of the shaft and to rotate with respect to the shaft around a rotation axis extending in the second direction;

a presser body including an insertion hole and a through hole, the insertion hole penetrating in the first direction, the through hole being configured such that the shaft is inserted therethrough, and the presser body being configured to move in the second direction with respect to the attachment body along the shaft in accordance with the rotation of the adjustment member; and a suppression body configured to come into contact with the adjustment member and to suppress the rotation of the adjustment member, the suppression body including an engagement portion and a recessed portion, the engagement portion being configured to engage with the adjustment member such that the adjustment member is rotatable, the recessed portion being recessed in a third direction that intersects both the first direction and the second direction, and the suppression body being configured to hold the presser body such that the attachment body and the presser body are disposed in the recessed portion.

5. The presser device according to claim 4, wherein the adjustment member includes a first wall portion and a second wall portion that are arranged side by side in the second direction, and is engaged with the engagement portion between the first wall portion and the second wall portion.

6. The presser device according to claim 4, further comprising:

a rotation stopper member connected to the attachment body and configured to restrict the rotation of the presser body around the shaft.

7. The presser device according to claim 4, wherein the attachment body includes a guide configured to guide a cord to the insertion hole from one side in the second direction with respect to the insertion hole.

8. The presser device according to claim 4, wherein the attachment body includes a first face, when the attachment portion is attached to the presser bar, arranged on one side of the presser bar in the second direction, a second face, when the attachment portion is attached to the presser bar, arranged on one side of the presser bar in the third direction, a third face, when the attachment portion is attached to the presser bar, arranged on another side of the presser bar in the third direction, and a first through hole which penetrates in the second direction and through which the shaft is inserted.

9. The presser device according to claim 4, wherein the adjustment member has a screw portion provided at an end portion of the adjustment member in a fourth direction opposite to the second direction.

10. A presser device comprising:

an attachment body including an attachment portion and a shaft, the attachment portion being configured to be attached to a presser bar included in a sewing machine and extending in a first direction, and the shaft extending in a second direction that intersects the first direction;

an adjustment member configured to be screwed together with one end of the shaft and to rotate with respect to the shaft around a rotation axis extending in the second direction;

a presser body including an insertion hole and an insertion portion, the insertion hole penetrating in the first direction, the insertion portion being configured such that the shaft is inserted therethrough, and the presser body being configured to move in the second direction with respect to the attachment body along the shaft in accordance with the rotation of the adjustment member; and a rotation stopper member connected to the attachment body and configured to restrict the rotation of the presser body around the shaft, wherein the presser body has a long hole that extends in the second direction, and the rotation stopper member is inserted through the long hole and is connected to the attachment body.

11. The presser device according to claim 10, wherein the attachment body includes the shaft extending in the second direction and having a hole, a first through hole which penetrates in the second direction and through which the shaft is inserted, and a second through hole connected to the first through hole and extending in a third direction that intersects both the first direction and the second direction, and the rotation stopper member is inserted through the long hole of the presser body and the second through hole, and is inserted into the hole provided in the shaft.

* * * * *